US006543868B2

(12) United States Patent
Cooper et al.

(10) Patent No.: US 6,543,868 B2
(45) **Date of Patent: *Apr. 8, 2003**

(54) DYNAMICALLY ADJUSTABLE INKJET PRINTER CARRIAGE

(75) Inventors: Brently L. Cooper, Brush Prairie, WA (US); Matt G. Driggers, Vancouver, WA (US); Thomas W. Ruhe, LaCenter, WA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/148,409

(22) Filed: Sep. 4, 1998

(65) Prior Publication Data

US 2002/0070987 A1 Jun. 13, 2002

(51) Int. Cl.[7] ..... B41J 25/308; B41J 23/00
(52) U.S. Cl. ..... 347/8; 347/37
(58) Field of Search ..... 347/8, 37, 104

(56) References Cited

U.S. PATENT DOCUMENTS

| | | | | |
|---|---|---|---|---|
| 3,750,790 A | | 8/1973 | Liles | 346/139 |
| 4,365,900 A | | 12/1982 | Gottsmann | 400/57 |
| 4,917,512 A | | 4/1990 | Mimura et al. | 347/8 |
| 5,074,685 A | | 12/1991 | Shimizu | 400/56 |
| 5,108,205 A | | 4/1992 | Stone | 347/8 |
| 5,156,464 A | * | 10/1992 | Sakai | 347/8 |
| 5,510,815 A | * | 4/1996 | Linder et al. | 347/8 |
| 5,678,936 A | | 10/1997 | Hino | 347/8 |
| 5,751,301 A | | 5/1998 | Saikawa | 347/8 |
| 5,815,171 A | | 9/1998 | Brugue | 347/8 |
| 5,980,018 A | | 11/1999 | Taylor | 347/31 |
| 6,000,775 A | | 12/1999 | Muraki | 347/8 |
| 6,042,217 A | | 3/2000 | Jones | 347/32 |
| 6,059,392 A | * | 5/2000 | Park | 347/8 |

FOREIGN PATENT DOCUMENTS

| | | |
|---|---|---|
| EP | 0591844 | 4/1994 |
| EP | 0827839 | 3/1998 |
| GB | 2319991 | 6/1998 |
| JP | 06166238 | 6/1994 |
| JP | 08310075 | 11/1996 |

OTHER PUBLICATIONS

U.S. patent application No. 09/123,456 "Apparently related case" Filed Jan. 1, 2001.
European Patent Office, European Search Report, Apr. 25, 2000.

* cited by examiner

*Primary Examiner*—Raquel Yvette Gordon
*Assistant Examiner*—An H. Do

(57) ABSTRACT

The spacing between the printhead of an inkjet printer cartridge and the print medium is dynamically controlled by an apparatus that slightly rotates the carriage that holds the cartridge. In one embodiment, the rotation is effected by actuation of a cam that resides between the rotatable carriage and a fixed part of the printer. The printhead-to-paper spacing is thus optimized for highest print quality.

16 Claims, 2 Drawing Sheets

DYNAMICALLY ADJUSTABLE INKJET PRINTER CARRIAGE

TECHNICAL FIELD

This invention relates to inkjet printers, and particularly to a technique for adjusting the printhead-to-paper spacing of an inkjet printer.

BACKGROUND AND SUMMARY OF THE INVENTION

An inkjet printer includes one or more ink-filled cartridges that are mounted to a carriage in the printer body. The carriage is reciprocated across the width of the printer as paper or other print media is advanced through the printer. Each ink-filled cartridge includes a printhead that is driven to expel droplets of ink though nozzles in the printhead toward the paper in the printer. The timing and nominal trajectory of the droplets are controlled to generate the desired text or image output and its associated quality.

An important design consideration in connection with such printers involves the spacing between the printhead nozzles and the paper, which can be called the pen-to-paper or printhead-to-paper (PTP) spacing. Generally, the resultant print quality is highest when the PTP spacing is minimized. In this regard, minimizing the PTP spacing reduces print quality degradation from "spray," which is the presence of small droplets having a trajectory that strays from that of the primary droplet. Moreover, minimizing PTP spacing is useful for minimizing the effects of errors that may be present in the trajectory of the primary droplet.

It is important, however, that this PTP spacing is sufficient to ensure that the printhead does not contact the paper, which could damage the printhead and/or smear the printed image. The possibility of contact may arise in instances where the amount and absorption of the liquid ink in the paper is such that the paper buckles upwardly, towards the nozzle. This buckling effect is known as "cockle." Even in the absence of cockle, other factors, such as the tolerances between the parts that support the paper and printer cartridge, dictate the minimum allowable PTP spacing.

Versatile inkjet printers allow one to print onto print media having different thicknesses. A simple example of this is a printer that allows printing on conventional paper stock and a relatively thicker envelope. Best print quality is achieved, therefore, where the PTP spacing is adjusted to account for variations in paper thickness.

Color inkjet printers commonly employ either one colored-ink cartridge, which may be interchangeable with a black-ink cartridge, or two to four cartridges mounted in the printer carriage to produce black print or a full spectrum of colors. In a printer with four cartridges, each print cartridge contains a different color ink, with the commonly used base colors of black, cyan, magenta, and yellow.

Generally, the print quality of black-ink images or text is more sensitive to PTP spacing than is color image quality. Also, color-ink printing is likely to involve a number of passes over substantially the same area on the paper. Thus, the possibility of smearing the ink may be greater when colored ink is printed. Accordingly, it would be desirable to vary the PTP spacing during a print job that calls for both colored and black ink sections, thereby to optimize the PTP spacing for color and black printing.

Instantaneous PTP spacing control, whether undertaken during a particular print job or between sheets of paper having different thicknesses, can be characterized as dynamic control, as opposed to, for example, mechanical methods developed with impact printers or the like, which halt printing until some mechanical intervention (such as lever movement) takes place to adjust the PTP spacing.

The present invention is directed to an apparatus and method for dynamically controlling PTP spacing. To this end, the relative position of the carriage is selectively and dynamically changed to vary the PTP spacing. As one aspect of this invention, this control is provided by electronic actuation that requires no manual intervention by the printer user.

As another aspect of the invention, the control is provided via the printer control firmware, thereby employing the primary components of the printer control system that exist for controlling the printhead operation and carriage movement normally required for printing.

Other advantages and features of the present invention will become clear upon study of the following portion of this specification and the drawings.

DETAILED DESCRIPTION OF PREFERRED EMBODIMENTS

Figure 1:
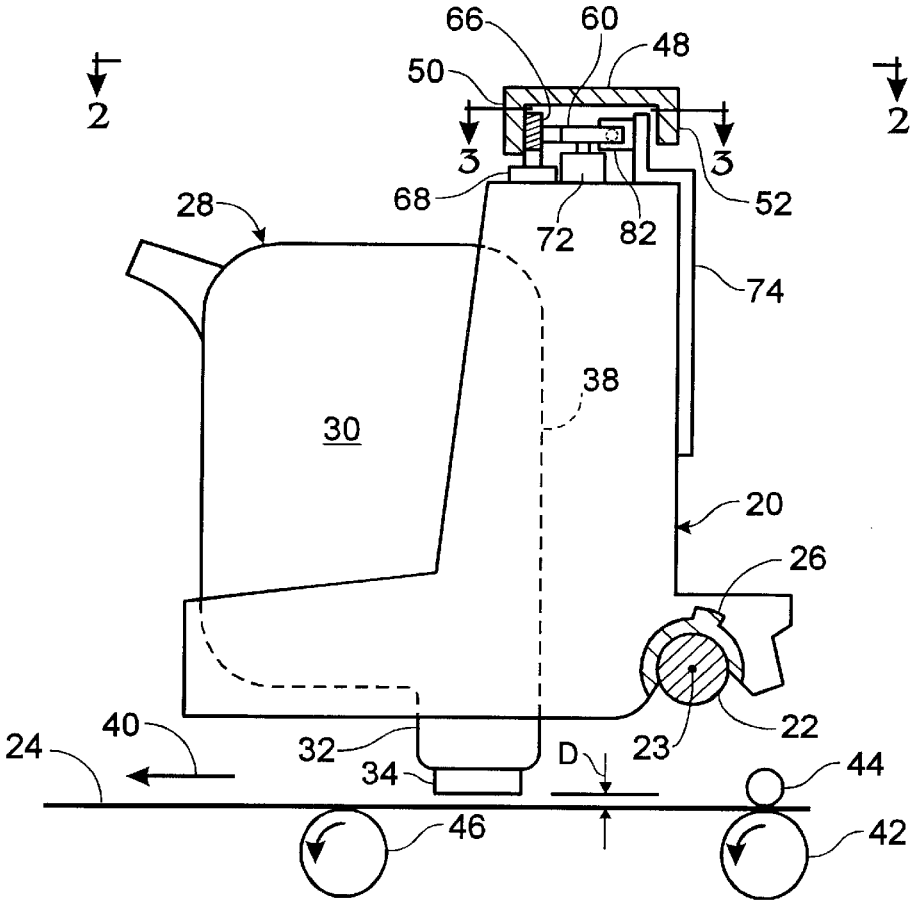
FIG. 1 is a diagram showing the side view of an irkjet printer carriage that incorporates the dynamic PTP spacing components of the present invention.
Figure 2:
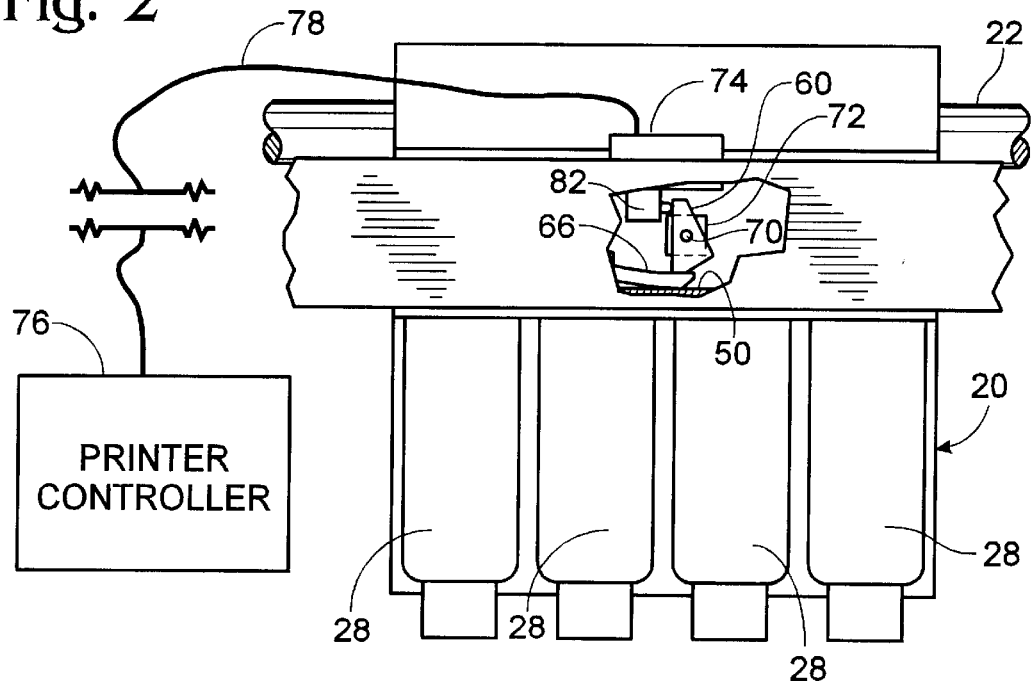
FIG. 2 is a diagram showing a view taken along line 2—2 of FIG. 1.

With reference to FIGS. 1 and 2, a preferred embodiment of the present invention includes a carriage 20 that is slidable along a support rod 22 that is housed within an inkjet printer. The rod 22 extends across the printer, oriented perpendicularly to the direction the paper 24 (or any other printing medium) is advanced through the printer. Bushings 26 may be fit into the carriage 20 to facilitate sliding.

One or more inkjet cartridges 28 are removably connected to the carriage. In the illustrated embodiment, four cartridges 28 are depicted to represent a printer that is adapted for color printing and carries cartridges of black, cyan, yellow, and magenta inks for this purpose. The cartridges 28 include plastic bodies that comprise liquid ink reservoirs 30 shaped to have a downwardly depending snout 32. A printhead 34 (the size of which is greatly enlarged in the drawing for clarity) is attached to the end of the snout. The printhead is formed with minute nozzles from which are ejected ink droplets onto the paper 24.

Each ink cartridge 28 has a circuit mounted on a wall 38. The circuit includes exposed contacts that mate with contacts of a circuit carried inside the carriage 20. The carriage is connected, as by a flexible, ribbon-type multi-conductor to the printer microprocessor, which provides to the cartridges control signals for precisely timed ejection of ink droplets. The droplets render text or images on the advancing paper as the carriage is reciprocated across the printer (i.e., into and out of the plane of FIG. 1).

FIG. 1 illustrates in somewhat simplified fashion a small portion of the path of the paper 24 through the printer. Each cartridge 28 is supported above the paper 24 by the carriage 20 such that printhead 34 is maintained at a desired PTP spacing "D." The paper 24 is picked from an input tray and driven into the paper path in the direction of arrow 40. The leading edge of the paper is fed into the nip between a drive roller 42 and an idler or pinch roller 44 and is driven in a controlled manner into the zone underlying the printhead 34, from where it encounters an output roller 46, and then advances into an output tray. Although an output roller 46 is shown in FIG. 1, a stationary surface may be placed in that vicinity for supporting the advancing paper.

The carriage 20 is mounted for limited rotational movement about the central axis of support rod 22, which axis is depicted as point 23 in the cross section portion of FIG. 1. Moreover, the center of gravity of the carriage 20 is located on one side of the rod 22 (FIG. 1, the left side) so that the carriage is normally urged by its weight toward a counterclockwise rotation. As a result, the upper portion of the carriage bears against a stationary part of the printer designated as a guide rail 48.

The guide rail 48 may be in the shape of an inverted "U" or channel and extends substantially across the width of the printer, parallel to the support rod 22. In a preferred embodiment, the rail 48 includes a downwardly depending outer leg 50 and inner leg 52.

The upper portion of the carriage 20 bears against the surface of the rail outer leg 50 to limit the counterclockwise rotation of the carriage with respect to the rod 22. Here, in the region where there is contact between the carriage 20 and rail leg 50 one finds the primary mechanisms of the present invention as now explained.

These control mechanisms are used to make the carriage 20 move toward and away from the rail leg 50, thus rotating, slightly, the carriage and its cartridges 28 about the rod 22. This carriage rotation changes the PTP spacing "D." In a preferred embodiment, the PTP spacing may vary from about 0.5 mm to slightly more than 1.5 mm, and can be dynamically changed to suit changes in print media type (envelopes, plastic film, coated paper, etc.) or thickness, colors employed in printing (i.e., color or black ink), or amount of ink.

More particularly, the apparatus and method of the present invention includes a cam 60 that is rotatably mounted at the top of the carriage 20. The cam includes at least two planar contact faces 62, 64, which may be alternately moved, as a result of cam rotation, into contact with a bendable but substantially incompressible reference slider 66 that is also mounted to the carriage. The amount of bending of the slider 66 is shown greatly exaggerated in the figures for the sake of illustration.

The reference slider 66 is a plastic member that is mounted to the top of the carriage 60 by attachment of a base portion 68 of the slider to the carriage. Away from the base, the slider 66 presents a bendable beam-like member that extends to be pinched between cam surfaces 62, 64 and the surface of the rail leg 50. Preferably, the spacer has a low coefficient of friction to facilitate sliding along the rail.

The pivot axis 70 of the cam 60 is fixed relative to the carriage. In one preferred embodiment, this axis is defined by the shaft of a small, reversible motor 72 that underlies the cam and is fastened to the carriage. The motor 72 is actuated via drive signals to rotate the cam as described more below. The drive signals are provided by leads (not shown) that extend between the motor 72 and small printed circuit (PC) board 74 that is mounted to one side of the carriage. This PC board 74 conveys the drive signal to the motor from a printer controller 76 via a flexible multi-conductor, such as shown at 78.

The printer controller 76 may be a conventional microprocessor based unit carried on board the printer and includes suitable signal conditioning, drivers, and interfaces for providing the motor control signals at selected times for actuating the cam 60.

Figure 3:
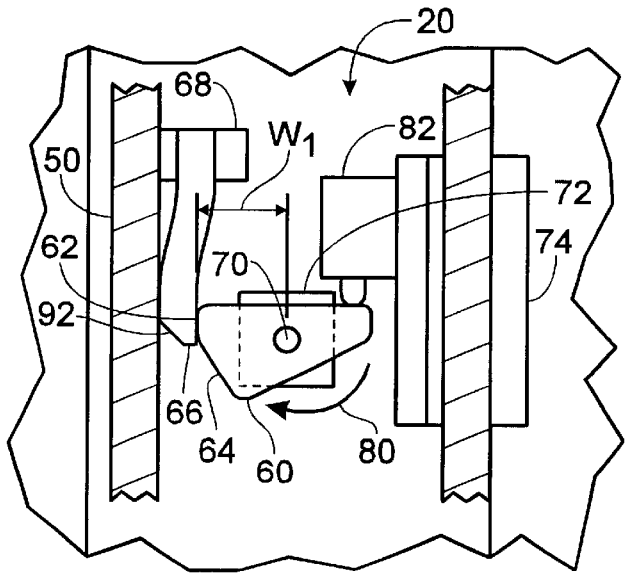
FIG. 3 is a diagram of a view taken along line 3—3 of FIG. 1 and enlarged to show an assembly that includes a cam member that is movable for changing the position of the carriage that carries the inkjet printer cartridges.

FIG. 3 depicts the cam 60 rotated by the motor 72 into one of two positions. It is noteworthy here that a cam shaped to provide more than two such positions is contemplated. In one such embodiment, the cam may have a continuously curved, eccentric contact face to thereby provided a very large or infinite number of positions.

In the position shown in FIG. 3, the face 62 of the cam bears against the slider 66, which in turn bears against the rail leg 50. The distance between the cam axis 70 and the cam face 62 (taken along a line normal to that face) is shown as $W_1$ in FIG. 3 and is greater than the distance $W_2$ (FIG. 4) between the cam axis 70 and the other cam face 64 (taken along a line normal to that face 64).

Movement of the cam into the position shown in FIG. 3 causes the cam to force the pivot axis 70 (hence, the carriage 20) to move away from the rail leg 50, which movement occurs as a result of the bending or yielding of the beam portion of the slider 66. This movement is rotational movement, in the clockwise sense with respect to FIG. 1, which has the effect of increasing or maximizing the PTP spacing "D." As noted above, movement of the carriage into this position might be selected to accommodate, for example, a relatively thick printing medium 24, such as an envelop.

It will be appreciated that the movement of the carriage may be a dynamic response to a user's selection of an "envelope" printing mode that may be available for selection from buttons on the printer, or from virtual buttons of the word processing software running on a computer that is associated with the printer. In this regard, the motor-drive signals generated by the printer controller in response to the user selection may be retained in the printer firmware and provided to the motor 72 on the carriage as required.

When it is desired to reduce the PTP spacing from that provided in the arrangement of FIG. 3, the cam 60 is moved to rotate in the direction of arrow 80 until its face 64 bears against the slider 66. As noted earlier, the force for moving the carriage 20 in this direction (i.e., counterclockwise rotation in FIG. 1) is attributable to gravity and the moment that arises from the offset center of gravity of the carriage.

Figure 4:
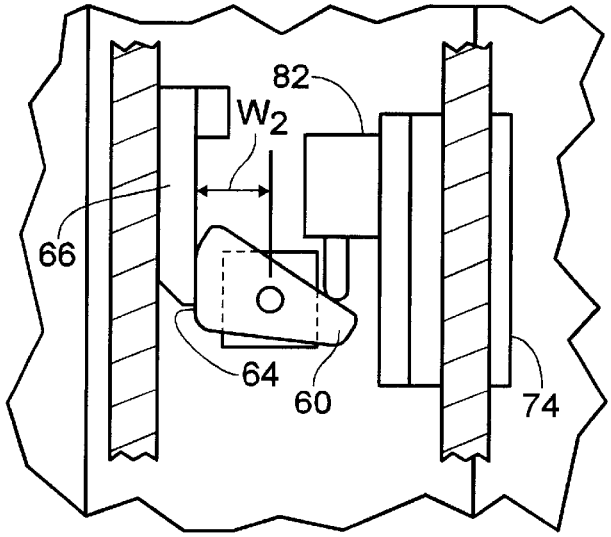
FIG. 4 is a diagram like FIG. 3, but showing the cam member moved into another position for placing the carriage in an alternative position.

In the position shown in FIG. 4, the relatively small distance $W_2$ between the cam axis 70 and the slider results in a relatively closer PTP spacing "D," which may be desired for paper of normal thickness. As before, the carriage movement into this position is dynamically controlled by the user.

In one embodiment, the motor 72 may be a stepper-type. Also, the printer controller 76 may verify the position of the cam 60 at any given time by the use of a microswitch 82. To this end, the microswitch 82 may be mounted to an extension of the PC board 74 to reside near the cam 60 so that the switch is activated each time the cam moves into and out of the position shown in FIG. 3. Another embodiment may directly verify or control PTP spacing "D" by placing an optical or other measuring device near the cartridge snout(s) 32. If located at the top of the carriage, such a device could measure, for example, the changes in the distance between the cam axis 70 and the rail 48.

Figure 5:
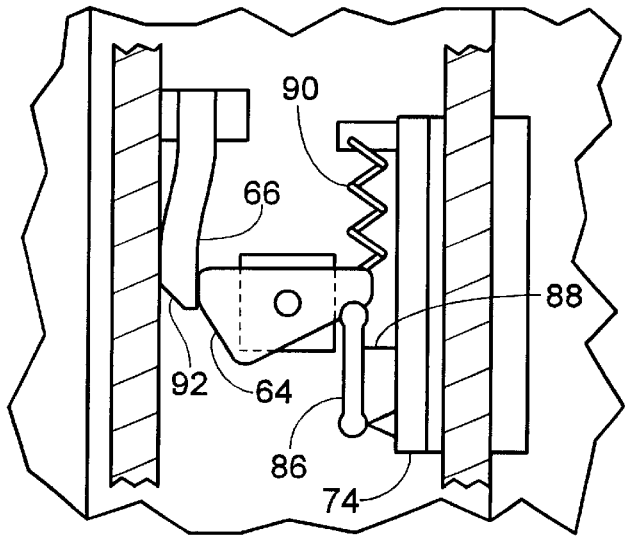
FIG. 5 is a view like FIG. 3, but illustrating one of the alternative approaches to actuating the cam member.

Any of a variety of means (solenoid, etc.) may be used to actuate the cam movements described above. One such alternative actuation technique is depicted in FIG. 5. There, a linear actuator 86 is pivotally mounted at each end between the PC board 74 (another extension of this board is shown in FIG. 5) and the cam 60. In one embodiment, the linear actuator 86 may be formed of shape memory alloy and driven, via a lead 88, with sufficient current to contract the link and move the cam from the position shown in FIG. 5 to the position shown in FIG. 4. The cam can be returned to the FIG. 5 orientation by a suitable tensioned spring 90 that extends between the cam 60 and PC board 74. Alternatively, another linear actuator may be employed for this purpose.

It is contemplated that the carriage may be moved to the extreme side of the printer away from engagement with the rail. In such an arrangement, a mechanical stop located there is used to limit the counterclockwise rotation of the carriage in lieu of the rail 48. The cam may thus be rotated into a selected position without pinching the slider 66 between a cam face and rail leg. As a result, appreciably less energy is required for rotating the cam, as compared to rotating the cam while the slider beam is pinched against the rail (since in the latter case the entire mass of the carriage and cartridges is moved; in the former, only the beam of the slider 66 is bent). For such an arrangement, the slider 66 includes a beveled portion 92 for enabling the slider to fit between the legs 50, 52 of the rail 48 as the carriage 20 moves back from the extreme side region. The beveled portion 92 thus acts as a simple inclined plane for forcing the clockwise rotation of the carriage as the carriage returns to engagement with the rail. Alternatively or additionally, the rail may have an inclined plane feature.

It is contemplated that the cam may be mounted for translational movement relative to the carriage, thus acting like a wedge. Moreover, the cam may be mounted securely enough, and have sufficient low-friction characteristics to eliminate the need for a slider member, such that the cam would bear directly on the printer rail.

Thus, while the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. An apparatus for controlling the spacing between a printhead of a printer and the print medium that is advanced through the printer, wherein the printhead is carried in a carriage that is rotatably mounted to the printer, and wherein the carriage bears against a rail member of the printer; the apparatus comprising:

a cam member mounted to the carriage and movable from a first to a second position relative to the rail member and connecting to a surface of the rail member in a manner that rotates the carriage in the course of moving between the first and second positions;

a bendable slider member mounted to the carriage and extending between the cam member and the rail member to connect the cam member and rail member surface, the slider member including a beveled portion on one end that is inclined relative to the rail surface; and an actuator carried on the carriage and operable for moving the cam member.

2. The apparatus of claim 1 wherein the cam member is shaped such that the spacing between the printhead and the print medium changes as a result of the carriage rotation.

3. The apparatus of claim 1 wherein the actuator is electrically operable.

4. The apparatus of claim 1 wherein the actuator is a link of shape memory alloy connected between the carriage and the cam member and driven to move the cam member.

5. The apparatus of claim 1 further comprising control means for delivering operator-generated electrical control signals to the actuator for moving the cam member.

6. The apparatus of claim 5 wherein the control means includes detector means for detecting and signaling the position of the cam member.

7. The apparatus of claim 1 including a switch mounted to the carriage and arranged to provide a signal indicative of the position of the cam member relative to the rail member.

8. A method of changing the spacing between a printhead in a printer and print medium that is advanced through the printer, the method comprising the steps of:

carrying the printhead in a carriage that is mounted for rotation in the printer;

locating a cam member on the carriage and selectively moving the cam member for selectively rotating the carriage, thereby changing the spacing between the printhead and the print medium; and providing a switch on the carriage to be actuated by movement of the cam member.

9. The method of claim 8 further comprising the step of:

moving the cam member via an electronically controlled actuator.

10. The method of claim 9 further comprising the step of:

locating the electronically controlled actuator on the carriage.

11. The method of claim 9 further comprising the step of:

controlling the actuator with electrical signals generated remote from the carriage.

12. The method of claim 11 further comprising the step of:

providing a link of shape memory alloy to serve as the actuator.

13. The method of claim 8 further comprising the step of:

mounting the cam member on the carriage for rotation adjacent to a fixed part of the printer.

14. The method of claim 13 further comprising the step of:

mounting to the carriage a bendable beam member that has one fixed end, and one free end that extends between the cam member and the fixed part of the printer.

15. A method for controlling the spacing between the printhead of a printer and the print medium that is advanced through the printer, wherein the printhead is carried in a carriage that is rotatably mounted to the printer, and wherein the carriage bears against a rail member of the printer; the method comprising the steps of:

providing on the carriage a bendable member having an inclined surface;

moving the carriage away from the rail;

bending the bendable member;

moving the carriage back against the rail so that the inclined surface of the bendable member wedges between the rail and carriage to cause rotation of the carriage.

16. The method of claim 15 wherein the bending step includes rotating a cam that is mounted to the carriage adjacent to the bendable member.

* * * * *